US010253588B2

(12) United States Patent
Larsen

(10) Patent No.: US 10,253,588 B2
(45) Date of Patent: Apr. 9, 2019

(54) FINISHING TOOL WITH INFLATABLE OVERSHOT

(71) Applicant: BAKER HUGHES, A GE COMPANY, LLC, Houston, TX (US)

(72) Inventor: Adam L. Larsen, Parker, CO (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 129 days.

(21) Appl. No.: 15/343,335

(22) Filed: Nov. 4, 2016

(65) Prior Publication Data

US 2018/0128072 A1 May 10, 2018

(51) Int. Cl.

| | |
|---|---|
| ***E21B 31/18*** | (2006.01) |
| ***E21B 33/127*** | (2006.01) |
| *E21B 23/00* | (2006.01) |
| *E21B 31/00* | (2006.01) |
| *E21B 31/12* | (2006.01) |
| *E21B 31/20* | (2006.01) |

(52) U.S. Cl.

CPC ..... *E21B 31/18* (2013.01); *E21B 33/1275* (2013.01); *E21B 23/00* (2013.01); *E21B 31/00* (2013.01); *E21B 31/12* (2013.01); *E21B 31/20* (2013.01); *E21B 33/127* (2013.01)

(58) Field of Classification Search

CPC ..... E21B 31/18; E21B 33/1275; E21B 23/00; E21B 33/127; E21B 31/12; E21B 31/20; E21B 31/00

See application file for complete search history.

(56) References Cited

U.S. PATENT DOCUMENTS

2009/0151951 A1* 6/2009 Erkol ..... E21B 31/20 166/301

* cited by examiner

*Primary Examiner* — Yong-Suk Ro
(74) *Attorney, Agent, or Firm* — Shawn Hunter

(57) ABSTRACT

A fishing tool for a fishing arrangement to remove a stuck fish or object from a wellbore. The fishing tool includes an overshot housing which defines an interior chamber. An inflatable bladder element resides within the interior chamber and is inflatable radially inwardly to capture a portion of the stuck fish. The fish is removed as the fishing arrangement is pulled out of the wellbore.

9 Claims, 3 Drawing Sheets

50
36
60
60
32
58
66
67
67
62
24
40
64
52
52
34
44
56
70
38
54
18
42
48
68
80
72
74
46

FINISHING TOOL WITH INFLATABLE OVERSHOT

BACKGROUND OF THE INVENTION

1. Field of the Invention

The invention relates generally to fishing tools and methods for removing objects from a wellbore.

2. Description of the Related Art

Fishing tools are used to remove stuck objects from a wellbore. Typical fishing tools include a mechanical latch or set of collets which are intended to engage a lip or similar structure on a stuck object, or fish, to be removed.

SUMMARY OF THE INVENTION

The invention provides a fishing tool design which is useful for removing fish having irregular shapes and/or a lack of gripping structures to which a conventional fishing tool might be secured. An exemplary fishing tool is described which includes an overshot housing which defines an interior chamber. An inflatable gripping bladder is located within the overshot housing. In an uninflated condition, the overshot housing can be disposed over and in a radially surrounding relation to the fish without interference from the gripping bladder. When the gripping bladder is in an inflated condition, it grips a portion of the stuck fish. Inflation fluid is transmitted from surface through a running string and fills the bladder to engage the fish.

In described embodiments, inflation fluid is flowed from the running string to an axial fluid pathway within the overshot housing. Fluid flow passages transmit the inflation fluid from the axial fluid pathway to an annular intermediate space which is defined radially between the bladder element and the overshot housing.

In certain embodiments, a piston member is moveably disposed within the axial fluid pathway. The piston member includes an axial bore along its length. Lateral flow ports are disposed through the piston member. The piston member is moveable between an upper position, wherein the lateral flow ports are blocked against flow, and a lower position, wherein the lateral flow ports are open to permit inflation fluid to flow from the axial bore to the fluid flow passages and into the annular intermediate space to inflate the bladder element. Inflation of the bladder element is preferably accomplished by landing a ball or plug within a ball seat formed within the axial bore of the piston member. Fluid pressure behind the ball or plug will rupture frangible members which retain the piston member in its upper position and shift the piston member to its lower position. Preferably, a flapper valve is located within the axial bore of the piston member and prevents inflation fluid from exiting the annular intermediate space.

In preferred embodiments, the inflatable bladder presents a roughened radially interior engagement surface which will contact and secure the fish when the bladder is inflated. Inflation fluid is transmitted from surface through a running string and fills the bladder to engage the fish.

In operation, a fishing tool constructed in accordance with the present invention is incorporated into a fishing arrangement with a running string. The fishing arrangement is run into a wellbore. The overshot housing of the fishing tool is disposed around a portion of a fish to be removed from the wellbore. The bladder element of the fishing tool is then inflated to capture the fish in a gripping relation. Thereafter, the fishing arrangement and fish are pulled out of the wellbore.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
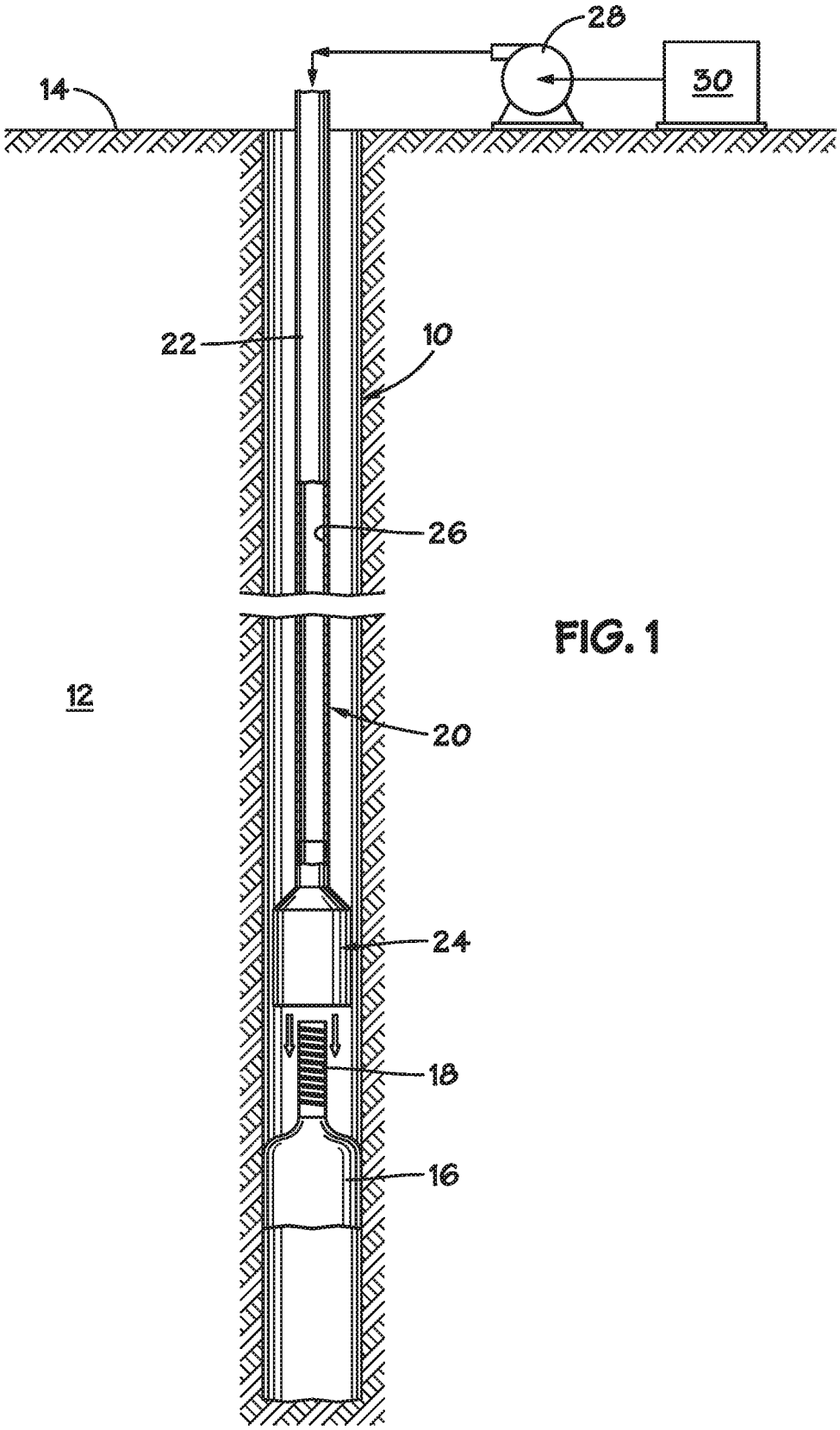
FIG. 1 is a side, cross-sectional view of an exemplary wellbore containing a stuck fish and a fishing arrangement in accordance with the present invention.

FIG. 1 depicts an exemplary wellbore 10 which has been drilled through the earth 12 from the surface 14. An object, or fish, 16 is stuck within the wellbore 10. As best seen with further reference to FIGS. 2-3, the fish 16 does not present significant annular projection or lip which could be easily engaged by a latch or collet. However, the fish 16 does present a reduced diameter portion 18.

In FIG. 1, a fishing arrangement, generally indicated at 20, is shown being disposed within the wellbore 10 to remove the fish 16. The fishing arrangement 20 includes a running string 22 with a fishing tool 24 affixed to its distal end. In certain embodiments, the running string 22 is coiled tubing. However, the running string 22 might also be made up of conventional tubular sections which are interconnected in an end-to-end fashion. A fluid flowbore 26 is defined along the length of the running string 22.

A fluid pump 28 and associated fluid source 30 are located at surface 14. The fluid pump 28 is associated with the running string 22 to flow inflation fluid from the fluid source 30 down through the flowbore 26 when desired. The fluid source 30 may include drilling fluids, oil, water or other liquids. In other embodiments, the fluid source 30 may comprise compressed air or other gases.

Figure 2:
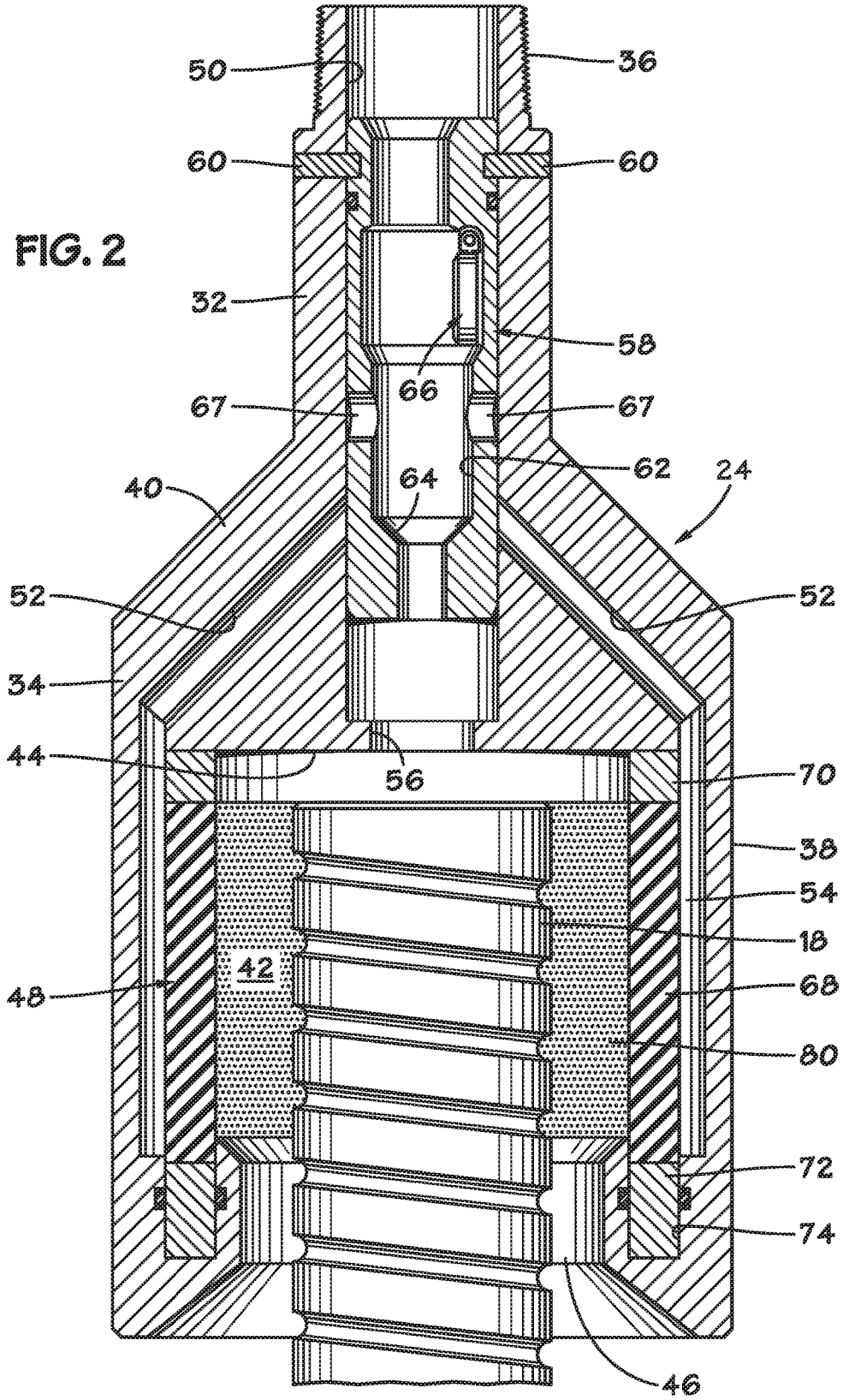
FIG. 2 is a side, cross-sectional view of an exemplary fishing tool constructed in accordance with the present invention.
Figure 3:
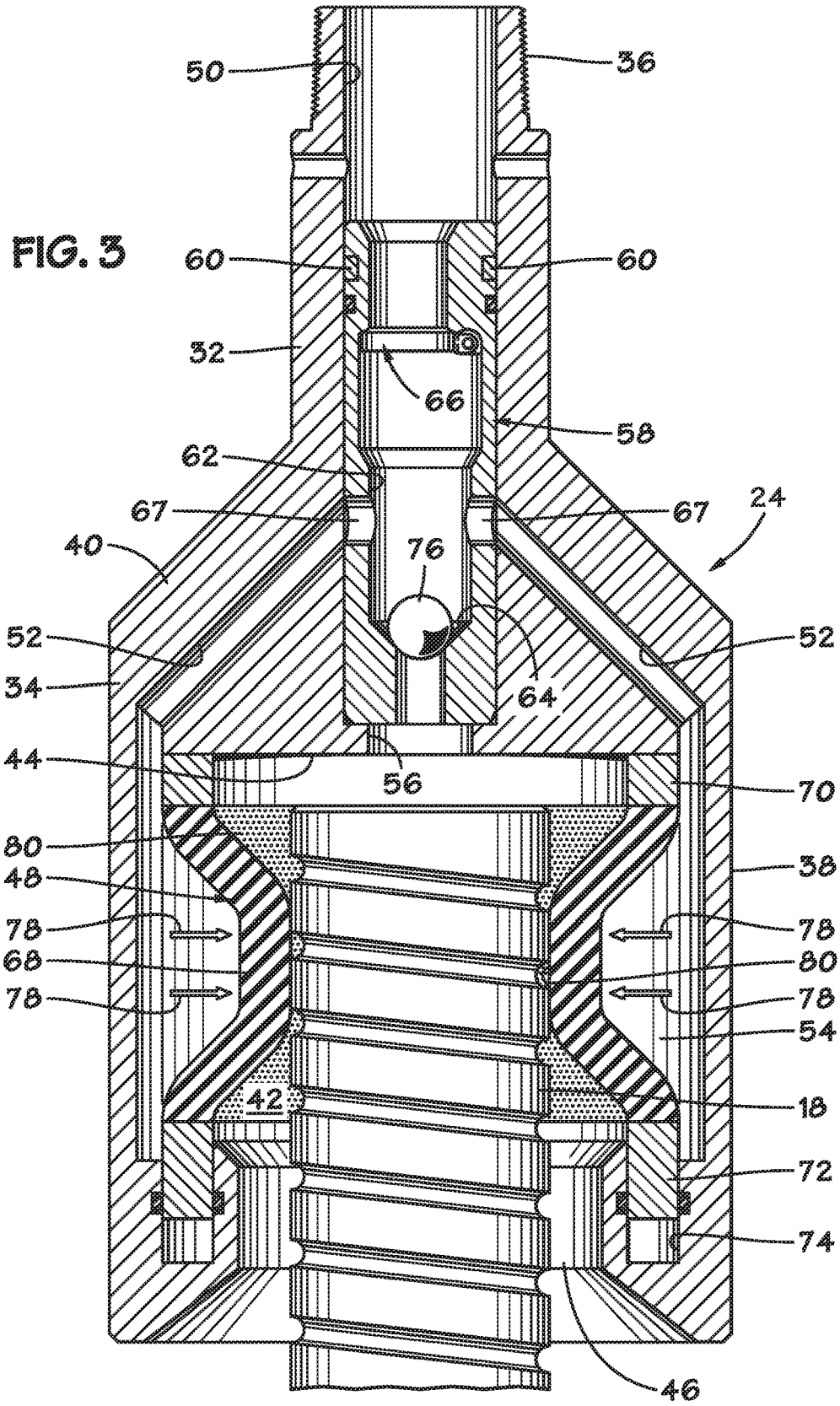
FIG. 3 is a side, cross-sectional view of the fishing tool shown in FIG. 2, now with the bladder element inflated to grip the stuck fish.

Referring now to FIGS. 2-3, it can be seen that the fishing tool 24 includes a neck portion 32 and an overshot portion 34. The overshot portion 34 will typically have a larger diameter than the neck portion 32. The neck portion 32 includes a threaded connector 36 for attachment of the fishing tool 24 to the running string 22.

The overshot portion 34 includes a generally cylindrical overshot housing 38 with a tapered transition 40 to the neck portion 32. An interior chamber 42 is defined within the overshot housing 38. The interior chamber 42 has an upper bulkhead 44 and an open lower end 46. An inflatable bladder element 48 is disposed within the overshot housing 38 and has an annular configuration.

An axial fluid pathway 50 is defined within the neck portion 32 and will align with the fluid flowbore 26 of the running string 22 when the fishing tool 24 is affixed to the running string 22. Fluid flow passages 52 extend from the axial fluid pathway 50 to an annular intermediate space 54 between the bladder 48 and the overshot housing 38. A flow restriction 56 is formed in the axial fluid pathway 50. The flow restriction 56 has a reduced diameter with respect to the diameter of the axial fluid pathway 50.

A piston member 58 resides within the axial fluid pathway 50. The piston member 58 is axially moveable within the fluid pathway 50, but initially, as FIG. 2 shows, frangible rupture members 60, such as shear pins, are used to secure the piston member 58 in place within the axial fluid pathway 50.

An axial bore 62 is defined along the length of the piston member 58 and permits fluid flow axially through the piston member 58. Preferably, a ball seat 64 is formed within the lower end of the bore 62. A flapper valve 66 is also preferably located within the axial bore 62. The flapper valve 66 is moveable between an open position (FIG. 2), wherein fluid flow is permitted through the axial bore 62, and a closed position (FIG. 3), wherein fluid flow upwardly through the axial bore 62 is blocked by the flapper valve 66. During run-in, the flapper valve 66 is in an open position. The flapper valve 66 may be spring-biased toward a closed position and retained in an open position by a releasable latch which could be controlled remotely using means known in the art. Lateral flow ports 67 are formed within the piston member 58. When the piston member 58 is in the upper position, shown in FIG. 2, the lateral flow ports 67 are blocked against fluid flow therethrough by the inner sidewall of the axial fluid pathway 50. When the piston member 58 is in the lower position (FIG. 3), fluid can flow from the axial fluid pathway 50 to the fluid flow passages 52 through the lateral flow ports 67.

The bladder element 48 includes an annular elastomeric sheet 68 with upper and lower metallic end rings 70, 72, respectively, which are affixed to the sheet 68. Preferably, the lower end ring 72 is slidably disposed within an annular channel 74 that is formed within the overshot housing 38. The annular sheet 68 is deformable.

In operation, the fishing arrangement 20 is run into the wellbore 10 as illustrated by FIG. 1. The reduced diameter portion 18 of the fish 16 is received within the interior chamber 42 of the fishing tool 24, as depicted in FIG. 2. In this configuration, any fluid from the fluid source 30 which is pumped into the running string 22 by the pump 28 would exit the flow restriction 56 of the fishing tool 24 and will not affect the bladder element 48.

In order to engage the fish 16, a plug is dropped into the flowbore 26 of the running string 22. The plug will typically take the form of a ball 76, but may have other shapes. Ball 76 lands upon the ball seat 64, as illustrated in FIG. 3. Pump 28 is activated to increase fluid pressure within the flowbore 26 behind the landed ball 76 and rupture the frangible members 60. The piston member 58 will then slide down within the axial fluid pathway 50 to the lower position illustrated in FIG. 3. In this position, the lateral ports 67 align with the fluid flow passages 52 in the overshot housing 38, allowing pressurized fluid within the axial fluid pathway 50 to enter the annular intermediate space 54. Increased fluid pressure within the intermediate space 54 will cause the bladder element 48 to inflate radially inwardly, as indicated by the arrows 78 in FIG. 3. The bladder element 48 will contact and engage the fish 16 in a gripping relation. In particular embodiments, the sleeve 68 of the bladder element 48 presents a roughened inner surface 80 to increase frictional engagement with the fish 16. The surface 80 may be roughened by the addition of grit or granular material or by molding of raised ridges or bumps upon the surface 80 or in other ways which might be known in the art. As depicted in FIG. 3, the lower end ring 72 will slide axially upwardly within the channel 74 to allow additional play for the elastomeric sheet 68 to be deformed radially inwardly. The closed flapper valve 66 will prevent pumped in fluid from exiting the annular intermediate space 54. Once the fish 16 is gripped by the bladder element 48, the fishing arrangement 20 can be withdrawn from wellbore 10 thereby removing the fish 16.

Those of skill in the art will recognize that numerous modifications and changes may be made to the exemplary designs and embodiments described herein and that the invention is limited only by the claims that follow and any equivalents thereof.

What is claimed is:

1. A fishing tool for capturing and removing an object from a wellbore, the fishing tool comprising:

an overshot housing defining an interior chamber into which a portion of the object will be received, the overshot housing having connector for connecting the fishing tool to a running string;

a bladder element residing within the overshot housing and being inflatable within the overshot housing to allow an engagement surface to grip the portion of the object that is received within the interior chamber;

an intermediate annular space defined within the fishing tool between the bladder element and the overshot housing; and wherein increased fluid pressure within the annular space will inflate the bladder element; and an axial fluid pathway which receives fluid from a running string; and a fluid flow passage which directs the fluid from the axial fluid pathway to the intermediate annular space;

a piston member that is disposed within the axial fluid pathway;

a lateral flow port disposed through the piston member; and wherein the piston member is axially moveable within the axial fluid pathway between an upper position, wherein fluid flow through the lateral flow port is blocked, and a lower position, wherein the fluid can flow from the axial fluid pathway to the fluid flow passage through the lateral flow port.

2. The fishing tool of claim 1 wherein the bladder element further comprises:

an annular elastomeric sleeve; and at least one end ring secured to the sleeve.

3. The fishing tool of claim 1 further comprising:

an axial bore defined within the piston member to permit fluid flow axially through the piston member; and a flapper valve located within the axial bore of the piston member, the flapper valve being moveable between an open position, which allows fluid flow through the axial bore, and a closed position, which blocks the fluid flow upwardly through the axial bore.

4. The fishing tool of claim 3 further comprising a ball seat formed within the axial bore of the piston member upon which a ball is landed to cause shifting of the piston member within the axial bore.

5. A fishing arrangement for removing an object from a wellbore, the fishing arrangement comprising:

a running string for disposing a fishing tool into the wellbore;

a fishing tool affixed to the running string, the fishing tool having:

an overshot housing defining an interior chamber into which a portion of the object will be received, the overshot housing having connector for connecting the fishing tool to a running string;

a bladder element residing within the overshot housing and being inflatable within the overshot housing by filling with fluid to allow an engagement surface to grip the portion of the object that is received within the interior chamber;

an intermediate annular space defined within the fishing tool between the bladder element and the overshot housing; and wherein increased fluid pressure within the annular space will inflate the bladder element;

an axial fluid pathway which receives fluid from the running string; and a fluid flow passage which directs the fluid from the axial fluid pathway to the intermediate annular space;

a piston member that is disposed within the axial fluid pathway;

a lateral flow port disposed through the piston member; and wherein the piston member is axially moveable within the axial fluid pathway between an upper position, wherein fluid flow through the lateral flow port is blocked, and a lower position, wherein the fluid can flow from the axial fluid pathway to the fluid flow passage through the lateral flow port.

6. The fishing arrangement of claim 5 wherein the bladder element further comprises:

an annular elastomeric sleeve; and at least one end ring secured to the sleeve.

7. The fishing arrangement of claim 5 further comprising:

an axial bore defined within the piston member to permit fluid flow axially through the piston member; and a flapper valve located within the axial bore of the piston member, the flapper valve being moveable between an open position, which allows fluid flow through the axial bore, and a closed position, which blocks the fluid flow upwardly through the axial bore.

8. The fishing arrangement of claim 7 further comprising a ball seat formed within the axial bore of the piston member upon which a ball is landed to cause shifting of the piston member within the axial bore.

9. A method of removing a stuck fish from a wellbore, the method comprising the steps of:

receiving a portion of the stuck fish within an interior chamber of a fishing tool of a fishing arrangement;

inflating a bladder element within the interior chamber to capture the stuck fish within the fishing tool;

providing an intermediate annular space defined within the fishing tool between the bladder element and the overshot housing, wherein increased fluid pressure within the annular space will inflate the bladder element;

providing an axial fluid pathway which receives fluid from a running string and a fluid flow passage which directs the fluid from the axial fluid pathway to the intermediate annular space;

providing a piston member that is disposed within the axial fluid pathway;

providing a lateral flow port disposed through the piston member, wherein the piston member is axially moveable within the axial fluid pathway between an upper position, wherein fluid flow through the lateral flow port is blocked, and a lower position, wherein the fluid can flow from the axial fluid pathway to the fluid flow passage through the lateral flow port; and removing the fishing arrangement and stuck fish from the wellbore.

* * * * *